United States Patent [19]

Bruno et al.

[11] Patent Number: 4,566,985

[45] Date of Patent: Jan. 28, 1986

[54] METHOD OF CLEANING USING LIQUID COMPOSITIONS COMPRISING STABILIZED MIXTURES OF ENZYMES

[75] Inventors: Leonard C. Bruno, Menomonee Falls; Mark M. Bruno, Milwaukee, both of Wis.

[73] Assignee: Applied Biochemists, Inc., Milwaukee, Wis.

[21] Appl. No.: 651,890

[22] Filed: Sep. 19, 1984

[51] Int. Cl.[4] ..... C11D 7/42; D06M 16/00

[52] U.S. Cl. ..... 252/174.12; 134/42; 252/173; 252/174.21; 252/DIG. 12; 252/DIG. 14; 435/188; 435/264

[58] Field of Search ..... 252/174.12, DIG. 12; 435/188, 264; 134/42

[56] References Cited

U.S. PATENT DOCUMENTS

| | | | |
|---|---|---|---|
| 3,532,599 | 10/1970 | Cooperman | 435/364 |
| 3,682,842 | 8/1972 | Innerfield | 252/539 |
| 3,717,550 | 2/1973 | Ziffer | 252/174.12 |
| 3,860,536 | 1/1975 | Landwerlen | 252/551 |
| 4,020,268 | 4/1977 | Nishikawa et al. | 536/62 |
| 4,092,175 | 5/1978 | Martin | 134/42 |
| 4,456,544 | 6/1984 | Lupova et al. | 252/174.12 |

OTHER PUBLICATIONS

Baker et al., "Irreversible Enzyme Inhibitors" CVI. Proteolytic Enzymes I. Bulk Tolerances in Trypsin-Inhibitor Complexes, J. Med. Chem., 10(6), pp. 1123-1128, 1967.

*Primary Examiner*—Prince E. Willis

*Attorney, Agent, or Firm*—Andrus, Sceales, Starke & Sawall

[57] ABSTRACT

A liquid enzyme cleaning composition. The composition includes a water base containing in solution a mixture of enzymes including a protease and at least one other enzyme. To inhibit the digestive effect of protease on the other enzymes in solution, the composition contains an effective amount of a benzamidine hydrohalide. At the time of use, the composition is diluted with additional water which releases the inhibitory effect of the benzamidine hydrohalide, so that the protease is free to act against proteinaceous soils in the material to be cleaned.

5 Claims, No Drawings

METHOD OF CLEANING USING LIQUID COMPOSITIONS COMPRISING STABILIZED MIXTURES OF ENZYMES

BACKGROUND OF THE INVENTION

Enzyme compositions have been used in the past as laundering detergents, household cleaners, and in other cleaning applications. The typical enzyme cleaning composition includes a mixture of enzymes, as for example, proteases which act against proteinaceous stains, amylases, which are effective against starches; cellulases, which will digest cellulosic materials; lipases, which are active against fats; peptinases, which are active on peptides; and ureases, which are effective against urine stains.

Enzymes are proteins and if the various enzymes are in water solution, the protease will act to digest the other enzymes, rendering the composition unstable and ineffective within hours. Because of this, enzyme compositions have not normally been marketed in water solution, but instead, have been sold as dry mixtures containing less than 5% moisture. The dry enzyme composition not only provides dusting problems, but the dry compositions are expensive due to the energy requirements for drying.

SUMMARY OF THE INVENTION

The invention is directed to a liquid enzyme composition containing a benzamidine hydrohalide, such as benzamidine hydrochloride, which inhibits the digestive effective of the protease.

The composition includes a water base containing, in solution, a mixture of various enzymes including a protease and at least one other enzyme. To inhibit the digestive effect of the protease on the other enzymes, the water solution also contains the benzamidine hydrochloride at a minimum concentration of 0.003 molar solution. At this concentration, the benzamidine hydrochloride will inhibit the digestive effect of the protease, so that the enzyme composition will remain stable for extended periods of time, up to several months or more.

At the time of use, the composition is diluted with additional water which reduces the concentration of the benzamidine hydrochloride to a value less than 0.003 molar solution, thereby releasing the inhibitive effect of the benzamidine hydrochloride and enabling the protease to be effective against proteinaceous materials.

Through the use of the invention, a stable liquid enzyme composition is achieved in which the digestive effect of the protease is inhibited so that the composition will remain stable for extended periods.

As the composition is a liquid, it can be produced for a lesser cost than dry enzyme compositions, is more convenient to use by the consumer, and eliminates dusting problems.

As a further advantage the composition is ecologically acceptable and will not generate pollutants during use. The composition is also non-hazardous to the user.

The enzyme composition of the invention can be used to clean a wide variety of different materials and can also be incorporated with other detergents or cleaners.

Other objects and advantages will appear in the course of the following description.

DESCRIPTION OF THE PREFERRED EMBODIMENT

The enzyme composition of the invention is a water solution containing a mixture of enzymes, including protease and one or more other enzymes, such as amylase, cellulase, lipase, peptinase and urease.

Specific examples of proteases that can be used are fungal prozyme 60,000 protease units/gram, fungal amano A 20,000 protease units/gram, acid stable 7,000 protease units/gram, bacterial neutral 12,000 protease units/gram, and papain 300–1200 MC units/gram.

Specific examples of amylases that can be used are bacterial amylase 17,000 bacterial amylase units/gram, bacterial amylase 175,000 bacterial amylase units/gram, fungal amylase and bacterial amylase 28,000,000 BAU/gm.

Specific examples of cellulases that can be used are cellulase AEI at 20,000 CMCase units/gram, Cellulase AIE 40,000 CMCase units/gram, cellulase AIE at 60,000 CMCase units/gram, cellulase AIE at 160,000 CMCase units/gram, cellulase trichoderma viride 20,000 CMCase units/gram, cellulase trichoderma viride 40,000 CMCase units/gram, cellulase trichoderma viride 60,000 CMCase units/gram, cellulase trichoderma viride 160,000 CMCase units/gram.

Specific examples of lipases that can be used are candida cylindracae lipase AP 60,000 units/gram and lipase aspergillis niger AP 10,000 units/gram.

Specific examples of peptinases that can be used are as follows: trypsin alphachymotrypsin chymotrypsin, pepsin, ficin and bromolain 1,800 to 2,000 GD u/gm from porcine pancrease, Mexican *Ficus Carica* sap, *Ananas Comosos* stems and leaves.

Specific examples of uriase, uricase, or urikinase, 1,500 to 800,000 u/gm from chickasaw beans, jack beans, *bacillus pasteruii,* porcine liver or *candida utilis.*

The concentration or amount of the various enzymes used in the water solution is not critical and varying concentrations can be used depending on the nature of the material to be cleaned. The maximum concentration of the enzymes is limited by saturation of the solution and cost.

To prevent the digestive effect of the protease on the other enzymes in the solution, the composition contains a benzamidine hydrohalide, preferably benzamidine hydrochloride. The benzamidine hydrochloride is employed in a minimum concentration of 0.003 molar solution and preferably in a molar solution of 0.003 to 0.006.

The exact mechanism by which the benzamidine hydrochloride inhibits the digestive effect of the protease system is not completely understood, but it is believed that the benzamidine hydrochloride will lock up or isolate the protease docking sites to render the protease inactive against the other enzymes.

At the time of use, the composition is diluted with additional water to reduce the concentration of the benzamidine hydrochloride to a vlaue less than 0.003 molar solution, thereby releasing the inhibitory effect and enabling the protease to retain its digestive effect against proteinaceous stains and materials.

The enzyme composition is preferably prepared in two phases. In the first phase the benzamidine hydrohalide is added to water, along with a small amount of a buffering salt, such as monosodium phosphate, to obtain a pH in the range of about 5.0 to 7.0. Following this, the enzymes are added to the solution with the protease normally being added first so that the benzamidine hydrohalide will deactivate the protease.

The composition is then mixed with a high shear mixer for a period of about 20 to 30 minutes and filtred through a 1 micron filter to remove bacteria and cellular debris.

A second phase is produced by adding a polyol, such as propylene glycol, glycerol or sorbitol, to water. The polyol is used to enhance the activity of the benzamidine hydrohalide.

To this second phase solution is added a non-ionic preservative for the enzyme, such as isoctyl phenoldodecylethoxylate, nonylphenoldecylethoxylate, alpha dodecanoldecylethoxylate, or alpha dodecanoldodecylethoxlate.

In addition, a bacteriastat, such as propylparahydroxy benzoate or methylparahydroxy benzoate, can be included in the second phase solution, along with a material, such as sodium thiosulfite, which acts as a heavy metal scavenger. If desired, a dye and fragrance can also be added to the second phase.

The second phase solution is mixed for a period of 20 to 30 minutes and then the two solutions are blended together, refiltered and bottled.

The enzyme composition of the invention can be used in a wide variety of cleaning applications. For example the composition can be used as a laundry cleaner, a household cleaner, a cleaner for surgical tools or equipment, a cleaner for ocular lenses, a cleaner for sewer traps or sewage disposal systems, a carpet destainer, a silverware presoaker, and the like.

Specific examples of the enzyme composition are as follows:

EXAMPLE I

Carpet Destainer:

| Formulation Ingredient | Weight Percent |
|---|---|
| Water | 33.07 |
| Cellulase 100 K | 0.25 |
| Anylase RAU-PL 54 M | 0.13 |
| Protease 360 K | 0.25 |
| Lipase 60 K | 0.15 |
| Benzamidine Hydrochloride | 0.05 |
| Water | 33.00 |
| Propylene Glycol | 26.35 |
| Surfonic N 95 | 5.50 |
| Propyl-para-hydroxy benzoate | 0.30 |
| Monosodium Phosphate | 0.25 |
| Sodium Thiosulfite | 0.50 |
| Lemon Scent | 0.20 |

EXAMPLE II

Silverware Presoak:

| Formulation Ingredient | Weight Percent |
|---|---|
| Water | 33.07 |
| Cellulase 100 K | 0.25 |
| Amylase BAU-PL 54 M | 0.13 |
| Protease 360 K | 0.25 |
| Lipase 60 K | 0.15 |
| Benzamidine Hydrochloride | 0.05 |
| Water | 33.0 |
| Propylene Glycol | 26.35 |
| Surfonic N 95 | 5.50 |
| Propyl-para-hydroxy benzoate | 0.30 |
| Monosodium Phosphate | 0.25 |
| Sodium Thiosulfite | 0.50 |

-continued

Silverware Presoak:

| Formulation Ingredient | Weight Percent |
|---|---|
| Lemon Scent | 0.20 |

EXAMPLE III

Oral Evacuation Holding Tank Cleaner:

| Formulation Ingredient | Weight Percent |
|---|---|
| Water | 32.86 |
| Benzamidine Hydrochloride | 0.05 |
| Protease 40 K | 0.25 |
| Lipase 60 K | 0.25 |
| Water | 33.34 |
| Propylene Glycol | 26.47 |
| Surfonic N 95 | 5.53 |
| Propyl-para-hydroxy benzoate | 0.30 |
| Monosodium phosphate | 0.25 |
| Sodium thiosulfonite | 0.50 |
| Lemon Scent | 0.20 |
| Green dye (to color) | 0.00004 |

Through the invention, a stable, water-based enzyme composition is achieved which will retain its enzymatic activity for extended periods of several months to one year.

As the composition is a liquid, it is less expensive to produce than dry powdered enzyme compositions and is easier to use by the consumer.

The product is also ecologically acceptable, for the digestive activity of the enzymes does not result in the production of ecologically undesirable materials.

Various modes of carrying out the invention are contemplated as being within the scope of the following claims particularly pointing out and distinctly claiming the subject matter which is regarded as the invention.

We claim:

1. A method of cleaning, comprising the steps of preparing a liquid enzyme composition having a water base and containing a mixture of enzymes dissolved in said water base, said enzymes including a protease and at least one other enzyme, said composition also including a benzamidine hydrohalide dissolved in said water base and present in a concentration at least equal to 0.003 molar solution, said benzamidine hydrohalide inhibiting the digestive effect of said protease on said other enzyme, diluting the composition with an additional quantity of water to reduce the concentration of said benzamidine hydrohalide to a value substantially less than 0.003 molar solution, and thereafter contacting the article to be cleaned with said diluted composition.

2. The method of claim 1, wherein said benzamadine hydrohalide is benzamadine hydrochloride.

3. The method of claim 1, wherein the benzamadine hydrohalide is dissolved in said water base in a concentration in the range of 0.003 to 0.006 molar solution.

4. A method of stabilizing an aqueous enzyme composition, comprising the steps of adding to an aqueous enzyme composition containing a protease and at least one other enzyme a benzamadine hydrohalide in a concentration at least equal to 0.003 molar solution, said benzamadine hydrohalide inhibiting the digestive effect of said protease on said other enzyme in said composition, and reactivating the activity of said protease by diluting the composition with water at the time of use to reduce the concentration of said benzamadine hydrohalide to a value less than 0.003 molar solution.

5. The method of claim 4, wherein said benzamadine hydrohalide is benzamadine hydrochloride.

* * * * *

UNITED STATES PATENT AND TRADEMARK OFFICE

CERTIFICATE OF CORRECTION

PATENT NO. : 4,566,985

DATED : January 28, 1986

INVENTOR(S) : LEONARD C. BRUNO ET AL

It is certified that error appears in the above-identified patent and that said Letters Patent is hereby corrected as shown below:

Col. 1, line 34, Cancel "effective" and substitute therefor ---effect---; Col. 2, line 17, Cancel "BAU" and substitute therefor ---RAU---; Col. 2, line 19, Cancel "AEI" and substitute therefor ---AIE---; Col. 2, line 32, After "trypsin" insert ---,--- (comma);, Col. 2, line 32, After "alphachymortrypsin" insert ---,--- (comma); Col. 3, line 4, Cancel "filtred" and substitute therefor ---filtered---;Col. 3, line 15, Cancel "dodecylethoxlate" and substitute therefor ---dodecyletholxylate ---; Col. 3, line 16, Cancel "bacteriastat" and substitute therefor ---bacteriostat"; Col. 3, line 29 Cancel "ocular" and substitute therefor ---occular---; Col. 3, line 43, Example I, Cancel "Anylase RAU-PL" and substitute therefor ---Amylaste-PL---; Col. 3, line 61, Example II, After "Amylase" delete "BAU-"; Col. 4, line 20, Example III, Cancel "thiosulfonite" and substitute therefor ---thiosulfite---; Claim 2, line 51, Cancel "benzamadine" and substitute therefor ---benzamidine---; Claim 2, line 52, Cancel "benzamadine" and substitute therefor ---benzamidine---; Claim 3, line 53, Cancel "benzamadine" and substitute therefor ---benzamidine---; Claim 4, line 58, Cancel "benzamadine" and substitute therefor ---benzamidine---; Claim 4, line 60, Cancel "benzamadine" and substitute therefor ---benzamidine---

UNITED STATES PATENT AND TRADEMARK OFFICE

CERTIFICATE OF CORRECTION

PATENT NO. : 4,566,985

DATED : January 28, 1986

INVENTOR(S) : LEONARD C. BRUNO ET AL

It is certified that error appears in the above-identified patent and that said Letters Patent is hereby corrected as shown below:

Claim 4, line 64, Cancel "benzamadine" and substitute therefor ---benzamidine---; Claim 5, line 66, Cancel "benzamadine" and substitute therefor ---benzamidine---; Claim 5, line 67, Cancel "benzamadine" and substitute therefor ---benzamidine---.

Signed and Sealed this

Eighth Day of September, 1987

*Attest:*

DONALD J. QUIGG

*Attesting Officer*

*Commissioner of Patents and Trademarks*